United States Patent [19]

Stanley

[11] 4,390,813

[45] Jun. 28, 1983

[54] TRANSFORMER FOR DRIVING CLASS D AMPLIFIER

[75] Inventor: Charles A. Stanley, San Jose, Calif.

[73] Assignee: Litek International Inc., Hayward, Calif.

[21] Appl. No.: 278,894

[22] Filed: Jun. 29, 1981

[51] Int. Cl.[3] ..... H05B 41/24; H01F 17/06; H01F 19/04

[52] U.S. Cl. ..... 315/248; 315/276; 315/278; 336/178; 323/215; 323/362

[58] Field of Search ..... 315/248, 267, 276, 278; 330/207 A, 188, 195; 336/170, 178, 229; 323/215, 362

[56] References Cited

U.S. PATENT DOCUMENTS 3,230,488 1/1966 Jacob ..... 336/229 X

*Primary Examiner*—Eugene La Roche
*Assistant Examiner*—Vincent DeLuca
*Attorney, Agent, or Firm*—Philip M. Hinderstein

[57] ABSTRACT

In an electrodeless discharge lamp of the type including an ionizable medium within a sealed envelope capable of emitting radiant energy when subjected to a radio frequency field, an oscillator for generating an output signal at a given radio frequency, a Class D RF amplifier including first and second transistors responsive to the oscillator output signal, and an induction coil responsive to the output of the amplifier, the coil being positioned in close physical proximity to the medium in the envelope for coupling to the medium an electric field having a magnitude sufficient to initiate ionization of the medium and a magnetic field for maintaining the ionization, there is disclosed an improved transformer for driving the Class D amplifier which results in a significant decrease in power consumption. The oscillator output signal is connected to the primary winding of a transformer which includes a toroidal, magnetic core. The transistors of the RF amplifier are connected to secondary windings wound on the core. The core is split between the secondary windings to form a high reluctance path which isolates the secondary windings from each other and critically couples the primary winding and the secondary windings.

9 Claims, 3 Drawing Figures

TRANSFORMER FOR DRIVING CLASS D AMPLIFIER

BACKGROUND OF THE INVENTION

1. Field of the Invention

The present invention relates to an electrodeless discharge lamp and, more particularly, to a transformer for driving a Class D amplifier for decreasing power consumption in an electrodeless discharge lamp.

2. Description of the Prior Art

In U.S. Pat. No. 4,010,400, there is disclosed an electrodeless discharge lamp of the type including an ionizable medium within a sealed envelope and including at least one particular ionizable gas at a given pressure capable of emitting radiant energy when subjected to a radio frequency field. An electric field having a magnitude sufficient to initiate ionization of the medium to form a radiation emitting discharge is coupled to the medium. Simultaneously, a radio frequency magnetic field for maintaining the ionization is coupled to the medium. If the various parameters of the lamp are properly selected, a high efficiency electrodeless fluorescent lamp is theoretically possible.

It is known to drive the medium by means of an oscillator, which is usually crystal controlled, for generating an output signal at a given radio frequency, an RF amplifier responsive to the oscillator output signal, and an induction coil and a capacitor connected in series and responsive to the output of the amplifier. The coil is positioned in close physical proximity to the medium in the envelope for coupling to the medium the electric field and the magnetic field.

In my copending application Ser. No. 278,888, filed concurrently herewith, and entitled Circuit Means for Efficiently Driving an Electrodeless Discharge Lamp, such application being assigned to Litek International, Inc., the assignee of the present application, there is disclosed circuit means for efficiently driving such an electrodeless discharge lamp. According to the invention described in such patent application, a Class D amplifier circuit is used without a load resistor and in a manner which substantially reduces $\frac{1}{2}CV^2f$ losses. A single circuit functions as a filter to reduce RFI and as a matching network to provide an operating voltage to set the light output level.

The preferred embodiment of RF amplifier includes a pair of series connected MOS transistors connected between a source of dc voltage and ground. The gates of the transistors are connected to separate secondary windings of a transformer. The windings are out of phase. The primary of the transformer receives the RF signal from the oscillator. By making the secondary windings out-of-phase windings of a single transformer, the transistors can be driven alternatively on and off, thereby producing a square wave output signal which alternates between the source of dc voltage and ground. This signal is filtered to produce the clean sine wave necessary to drive the discharge.

In such a drive system for a Class D amplifier, power is consumed only during the switching interval. That is, the transistors consume no power when they're either on or off, current only flowing, called the idling current, during the switching interval. If the switching interval can be decreased, the time interval during which the idling current flows will be decreased, as will be the power consumed. Since efficiently converting input energy into output power is essential if an electrodeless fluorescent lamp is to compete effectively with other types of lamps, the reduction in the idling current to a minimum value is essential.

In the past, it has been common practice to wind the primary and secondary windings on a common toroidal, magnetic core which maximizes coupling between the primary and each of the secondaries. However, there exists some inherent capacitance across the gates of each MOS transistor so that there is also mutual coupling between the secondaries. That is, the turning on of one transistor is affected by the turning off of the other and vice-versa because of the mutual charge that flows between the two input capacitances. In the past, this has created a lower limit on the switching time.

SUMMARY OF THE INVENTION

According to the present invention, these problems are solved by the provision of means for isolating the secondary windings from each other and critically coupling the primary winding and each secondary winding. This is achieved by forming a high reluctance path between the secondary windings. In this manner, the interaction of one transistor turning off and affecting the other one turning on is essentially eliminated. This decreases the switching interval, decreases the time that the idling current flows, and decreases power consumption. Furthermore, by isolating the transistors, production is made easier because transistors need not be matched as closely.

Briefly, in a transformer for use in driving an RF amplifier from an oscillator in an electrodeless discharge lamp including a toroidal magnetic core, a primary winding wound on the core, and first and second secondary windings on the core, the primary and secondary windings being spaced around the core, there is disclosed the improvement wherein the core is split between the secondary windings to form an air gap. This isolates the secondary windings from each other and critically couples the primary winding and each secondary winding.

OBJECTS, FEATURES AND ADVANTAGES

It is therefore the object of the present invention to solve the problems encountered heretofor in decreasing switching time in driving Class D amplifiers. It is a feature of the present invention to solve these problems by the provision of a split toroidal, magnetic core. An advantage to be derived is the efficient driving of a Class D amplifier. A further advantage is isolating the secondary windings from each other and critically coupling the primary winding and the secondary windings in a transformer. A further advantage is a decrease in power consumption in driving a Class D amplifier. A still further advantage is that the transistors in a Class D amplifier need not be matched as closely.

Still other objects, features, and attendant advantages of the present invention will become apparent to those skilled in the art from a reading of the following detailed description of the preferred embodiment constructed in accordance therewith, taken in conjunction with the accompanying drawings wherein like numerals designate like or corresponding parts in the several figures and wherein:

DESCRIPTION OF THE PREFERRED EMBODIMENT

Figure 1:
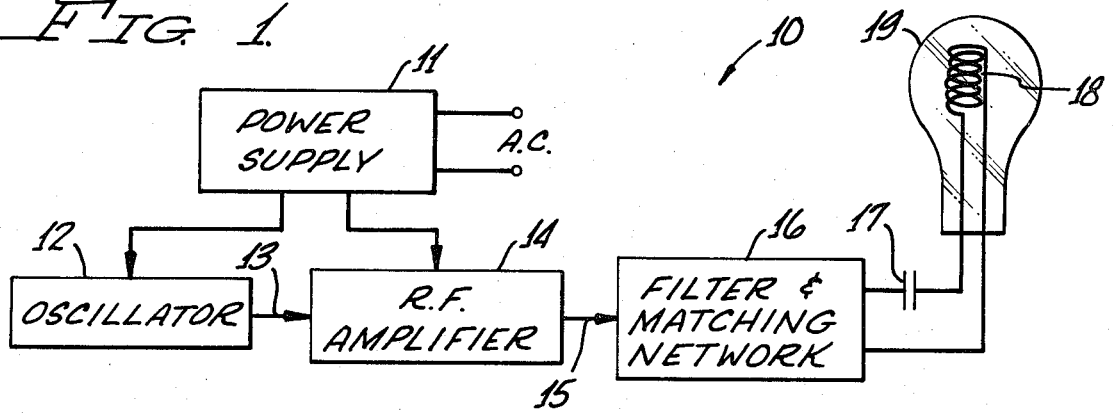
FIG. 1 is a block diagram of an electrodeless discharge lamp.

Referring now to the drawings and, more particularly, to FIG. 1 thereof, an electrodeless discharge lamp, generally designated 10, of the type described in U.S. Pat. No. 4,010,400, and as more fully described in my beforementioned copending application, includes several basic components. The first component is a power supply 11 which receives ac power at its input and produces one or more dc voltages at its output for powering the remaining components. Such components typically include an oscillator 12, which is usually crystal controlled, for generating an output signal at 13.56 MHz. This signal is applied over a line 13 to an RF amplifier 14 which produces the power necessary to drive the discharge. The output of RF amplifier 14 on line 15 is preferably applied via a filter and matching network 16 to a series capacitor 17 and induction coil 18, the latter extending into a cavity within a sealed envelope 19. Positioned within envelope 19 is a ionizable medium including at least one particular ionizable gas at a given pressure capable of emitting radiant energy when subjected to a radio frequency field.

The series capacitor 17 and inductor 18 function to multiply the output of RF amplifier 14 to create across coil 18 an electric field having a magnitude sufficient to initiate ionization of the medium in envelope 19. Coil 18 also couples to the medium a radio frequency magnetic field for maintaining ionization. If the various parameters of the lamp are properly selected, a high efficiency electrodeless fluorescent lamp is theoretically providable.

Figure 2:
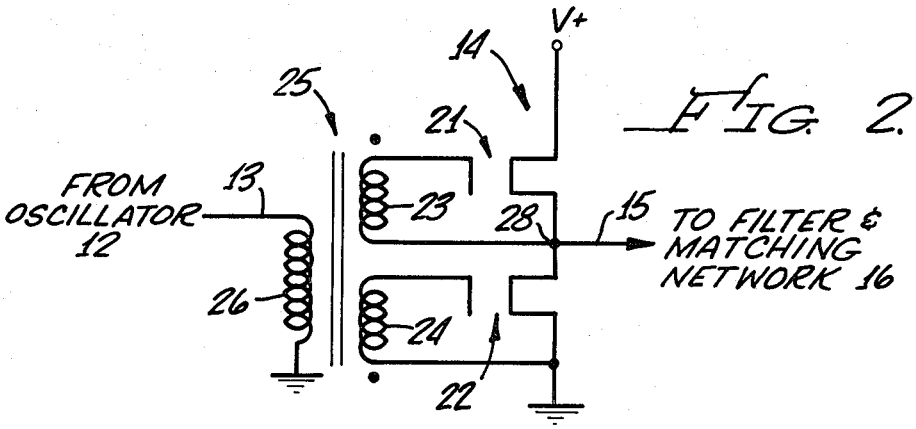
FIG. 2 is a circuit diagram of a preferred embodiment of RF amplifier for use in the lamp of FIG. 1.

According to my copending application, and referring now to FIG. 2, RF amplifier 14 is preferably a Class D amplifier including a pair of series connected MOS transistors 21 and 22, the source of transistor 21 being connected to a dc voltage V+ in power supply 11 and the drain of transistor 22 being connected to ground. The drain of transistor 21 is connected to the source of transistor 22. The junction 28 between transistors 21 and 22 becomes the output of RF amplifier on line 15.

In order to drive transistors 21 and 22 alternately on and off, the gates thereof are connected to two separate secondary windings 23 and 24 of a transformer 25. Windings 23 and 24 are out of phase. The primary 26 of transformer 25 receives the 13.56 MHz signal on line 13 from oscillator 12.

MOS devices are chosen for transistors 21 and 22 because at the frequency of operation of lamp 10, they are much more efficient. Bipolar devices have a relatively fast turn on time, but are very slow in turning off due to storage time in their bases. With MOS devices, transistors 21 and 22 turn on faster and turn off just as fast.

The voltage at the output of a Class D amplifier, at junction 28, is a square wave which alternates between V+ and ground. Filter and matching network 16 converts the square wave to a sine wave to drive the load represented by the medium in envelope 19. Network 16 also matches the output impedance of amplifier 14 to the input impedance of the discharge to set the light output level.

The signal from oscillator 12 is coupled to transistors 21 and 22 via transformers 25 to switch transistors 21 and 22 alternately on and off. Thus, transistors 21 and 22 operate as gates to swing the voltage at junction 28 between V+ and ground. During the time that transistors 21 and 22 are on or off, they draw no current. It is only during the switching interval that current flows, called the idling current. The idling current is dissipated as heat and serves as a source of power loss since it is not converted to usable light energy. Thus, the faster that gates 21 and 22 can be switched, the shorter the time that the idling current flows and the less power that is consumed.

The accepted practice is to wind windings 23, 24, and 26 on a common core. This is done either with a bar, a rod, or a toroidal core. Since a bar or rod is much more susceptible to picking up stray fields, a toroidal core is much more common and desirable.

On the other hand, the gates of transistors 21 and 22 each have input capacitance. Thus, each gate circuit is in effect a resonant network and these resonant networks are mutually coupled by the common toroidal core. This mutual coupling effect results in the turning on of one transistor being affected by the turning off of the other because of current flow between the two resonant circuits.

Figure 3:
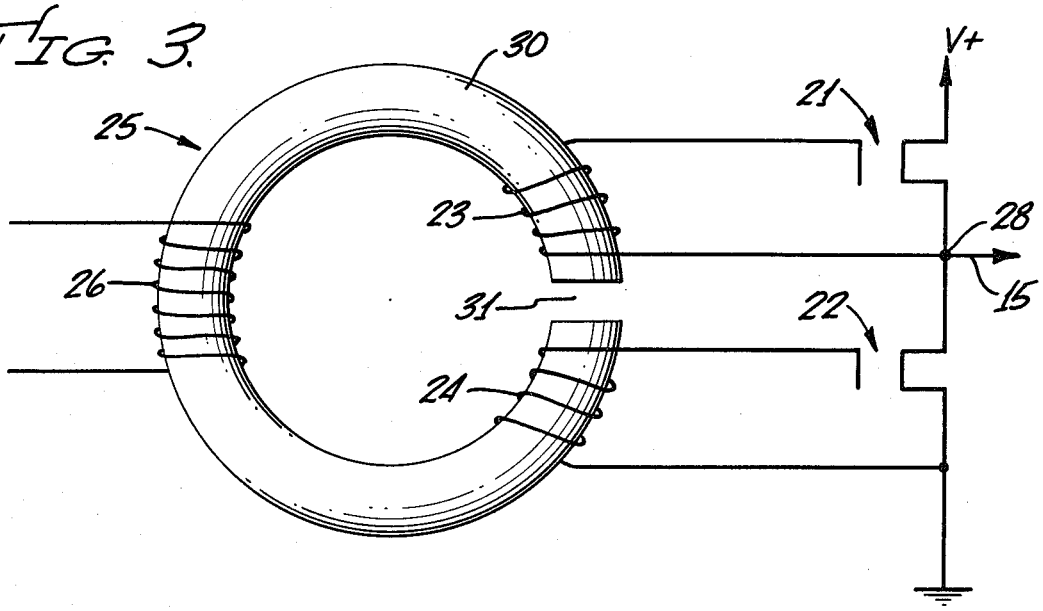
FIG. 3 is a plan view of a transformer for use in coupling the output of the oscillator to the input of the RF amplifier in the circuit of FIG. 2.

Referring now to FIG. 3, there is shown the preferred embodiment of transformer 25 for use in lamp 10. That is, transformer 25 includes windings 23, 24, and 26 wound on a common toroidal, magnetic core 30, windings 23, 24, and 26 being spaced around core 30. Core 30 is split between secondary windings 23 and 24 to provide a gap 31, preferably an air gap, which forms a high reluctance path between windings 23 and 24.

The effect of providing gap 31 in core 30 is significant. On the one hand, gap 31 does not diminish the coupling between primary winding 26 and each of secondary windings 23 and 24. In fact, gap 31 permits primary winding 26 to be critically coupled to secondary windings 23 and 24. On the other hand, secondary windings 23 and 24 are isolated from each other so that the interaction between transistors 21 and 22 is essentially eliminated, or at least minimized. By minimizing the interaction between the two transistors 21 and 22, each is permitted to switch on and off more rapidly, so that the idling current flows for a shorter period of time, decreasing power consumption.

Another benefit of gap 31 is that in production, transistors 21 and 22 need not be matched as closely. If transistors 21 and 22 are slightly different, with slightly different gate capacitances, the elimination of the interaction between the inputs eliminates these differences as a problem.

While the invention has been described with respect to the preferred physical embodiment constructed in accordance therewith, it will be apparent to those skilled in the art that various modifications and improvements may be made without departing from the scope and spirit of the invention. Accordingly, it is to be understood that the invention is not to be limited by the specific illustrative embodiment, but only by the scope of the appended claims.

I claim:

1. In a transformer including a toroidal magnetic core, a primary winding on said core, and first and second secondary windings on said core, said primary and secondary windings being spaced around said core, the improvement wherein said core is split between said secondary windings to form a high reluctance path.

2. In a transformer including a toroidal, magnetic core, a primary winding wound on said core, and first and second secondary windings on said core, said primary and secondary windings being spaced around said core, the improvement comprising:

means for isolating said secondary windings from each other, said isolating means comprising:

means forming a high reluctance path between said secondary windings.

3. In a transformer according to claim 2, the improvement wherein said means forming a high reluctance path comprises:

a gap in said magnetic core, between said secondary windings.

4. In a transformer according to claim 3, the improvement wherein said gap is an air gap.

5. In an electrodeless discharge lamp of the type including an ionizable medium within a sealed envelope capable of emitting radiant energy when subjected to a radio frequency field, an oscillator for generating an output signal at a given radio frequency, a Class D RF amplifier including first and second transistors connected in series and adapted to be driven alternately on and off by said oscillator output signal, a transformer including a toroidal, magnetic core, a primary winding on said core responsive to said oscillator output signal, first and second secondary windings on said core coupled to said first and second transistors, respectively, said primary and secondary windings being spaced around said core, and an induction coil responsive to the output of said amplifier, said coil being positioned in close physical proximity to said medium in said envelope for coupling to said medium an electric field having a magnitude sufficient to initiate ionization of said medium and a magnetic field for maintaining said ionization, the improvement comprising:

means for isolating said secondary windings from each other, said means comprising:

means forming a high reluctance path between said secondary windings.

6. In an electrodeless discharge lamp according to claim 5, the improvement wherein said means forming a high reluctance path comprises:

a gap in said magnetic core, between said secondary windings.

7. In an electrodeless discharge lamp according to claim 6, the improvement wherein said gap is an air gap.

8. In a transformer for use in driving an RF amplifier from an oscillator in an electrodeless discharge lamp including a toroidal, magnetic core, a primary winding wound on said core, and first and second secondary windings on said core, said primary and secondary windings being spaced around said core, the improvement comprising:

means forming a gap in said magnetic core, between said secondary windings, for isolating said secondary windings from each other.

9. In a transformer according to claim 8, the improvement wherein said gap is an air gap.

* * * * *